US005727959A

United States Patent [19]

Yagi et al.

[11] Patent Number: 5,727,959

[45] Date of Patent: Mar. 17, 1998

[54] LEVER FITTING-TYPE CONNECTOR

[75] Inventors: Sakai Yagi; Tamio Watanabe; Toru Nagano, all of Shizuoka, Japan

[73] Assignee: Yazaki Corporation, Tokyo, Japan

[21] Appl. No.: 563,386

[22] Filed: Nov. 28, 1995

[30] Foreign Application Priority Data

Nov. 29, 1994 [JP] Japan ..... 6-294218

[51] Int. Cl.[6] ..... H01R 13/44

[52] U.S. Cl. ..... 439/157; 439/342; 439/347; 439/160

[58] Field of Search ..... 439/152–160, 439/342, 347, 372

[56] References Cited

U.S. PATENT DOCUMENTS

| | | | |
|---|---|---|---|
| 4,586,771 | 5/1986 | Kraemer et al. | 339/75 |
| 4,981,440 | 1/1991 | Werner et al. | 439/347 |
| 5,104,333 | 4/1992 | Hatagishi et al. | 439/342 |
| 5,147,213 | 9/1992 | Funk et al. | 439/342 |
| 5,183,408 | 2/1993 | Hatagishi | 439/157 |
| 5,238,418 | 8/1993 | Koiner | 439/157 |
| 5,256,080 | 10/1993 | Bright | 439/342 |
| 5,478,255 | 12/1995 | Hashiguchi | 439/342 |

FOREIGN PATENT DOCUMENTS 61-203581 9/1986 Japan .

*Primary Examiner*—J. J. Swann

*Attorney, Agent, or Firm*—Morgan, Lewis & Bockius LLP

[57] ABSTRACT

A lever having pivotal movement-purpose cam grooves is pivotally mounted on one connector. Engagement pins for the pivotal movement-purpose cam grooves are formed on the other connector. Auxiliary engagement pins are formed on the other connector in juxtaposed relation to the engagement pins, respectively. Sliding movement-purpose slanting portions, extending transversely of the lever for cooperating respectively with the auxiliary engagement pins, are formed in the lever. The pivotal movement-purpose cam groove has a communication groove for receiving the engagement pin. Movement-purpose elongate grooves for cooperating respectively with lever pivot pins are formed in the one connector, and extend in a direction of projection of the lever. A pair of retaining holes for a lock projection are formed in the one connector, and are spaced from each other in the lever-projecting direction.

8 Claims, 4 Drawing Sheets

LEVER FITTING-TYPE CONNECTOR

BACKGROUND OF THE INVENTION

1. Field of the Invention

This invention relates to a lever fitting-type connector in which an operating lever is slidably provided so that the length of projection of this lever from the connector can be reduced while a leverage rate is increased when the lever is to be pivotally moved, thereby providing an adequate operating force.

2. Related Art

FIGS. 7(*a*) to 7(*c*) shows a conventional lever fitting-type connector disclosed in Japanese Patent Unexamined Publication No. 4-62772.

This connector 41 comprises a female connector 43 provided with an operating lever 42, and a male connector 46 including an engagement pin 45 engageable in a cam groove 44 formed in the operating lever 42, as shown in FIG. 7(*a*). The cam groove 44 in the operating lever 42 has an arcuate configuration defined by an arc of a circle whose axis is eccentric from an axis 47 of pivotal movement of the operating lever 42.

The two connectors 43 and 46 are manually fitted together provisionally, and in this condition the engagement pin 45 is disposed in an inlet portion 44*a* of the cam groove 44 as shown in FIG. 7(*b*). Then, the lever 42 is pivotally moved in a direction of arrow B to engage the engagement pin 45 in the cam groove 44, so that the male connector 46 is inserted into the female connector 43, as shown in FIG. 7(*c*). Thus, the connectors can be easily fitted together by the leverage provided by the lever 42.

For reducing the operating force of the lever 42, it is necessary to increase the length of the lever 42, or to increase the angle of pivotal movement of the lever 42. In such a case, however, the amount of projection of the lever 42 from the connector is inevitably increased, and besides because of such increased length of the lever 42, the lever 42 interferes with an external object prior to the fitting of the connector as during the shipping, so that the lever 42 may be broken.

SUMMARY OF THE INVENTION

With the above problems in view, it is an object of this invention to provide a lever fitting-type connector in which the interference with a lever prior to the fitting of the connector is prevented, and an adequate lever operating force can be obtained.

To achieve the above object, the present invention provides a lever fitting-type connector wherein a lever, which has one of a pivotal movement-purpose cam groove and an engagement pin engageable in the cam groove, is pivotally mounted on one of two connectors; and the other connector has the other of the pivotal movement-purpose cam groove and the engagement pin, wherein an auxiliary engagement projection juxtaposed with the engagement pin, as well as a sliding movement-purpose slanting portion extending generally transversely of the lever for cooperating with the auxiliary engagement projection, is provided at the lever or the other connector; the pivotal movement-purpose cam groove has a communication groove for receiving the engagement pin; and the one connector or the lever has an elongate groove for receiving a lever pivot pin so as to allow the lever to move in a lever-projecting direction.

A pair of retaining holes for engagement with a lock projection on the one connector can be formed in the lever, these retaining holes being spaced from each other in the lever-projecting direction.

When the two connectors are joined together, the engagement pin enters the communication groove, and the auxiliary engagement projection enters an inlet portion of the sliding movement-purpose slanting portion. In this condition, the lever pivot pin is engaged in an inner end of the movement-purpose elongate groove, and the lever is disposed in a retracted position with respect to the connector. Then, the lever is pulled in the lever-projecting direction. As a result, the engagement pin enters the pivotal movement-purpose cam groove through the communication groove, and the auxiliary engagement projection moves along the sliding movement-purpose slanting portion. The pivot pin moves to a front end portion of the movement-purpose elongate groove, so that the leverage rate is increased. In this condition, the lever is pivotally moved. The auxiliary engagement projection passes through the outlet portion of the sliding movement-purpose slanting portion to the exterior. The two connectors can be easily fitted together by pivotally moving the long lever.

BRIEF DESCRIPTION OF THE DRAWINGS

FIG. 7(*b*) is a side-elevational view showing a lever as pivotally moved; and

FIG. 7(*c*) is a side-elevational view showing the connector in its fitted condition.

DETAILED DESCRIPTION OF THE PREFERRED EMBODIMENTS

Figure 1:
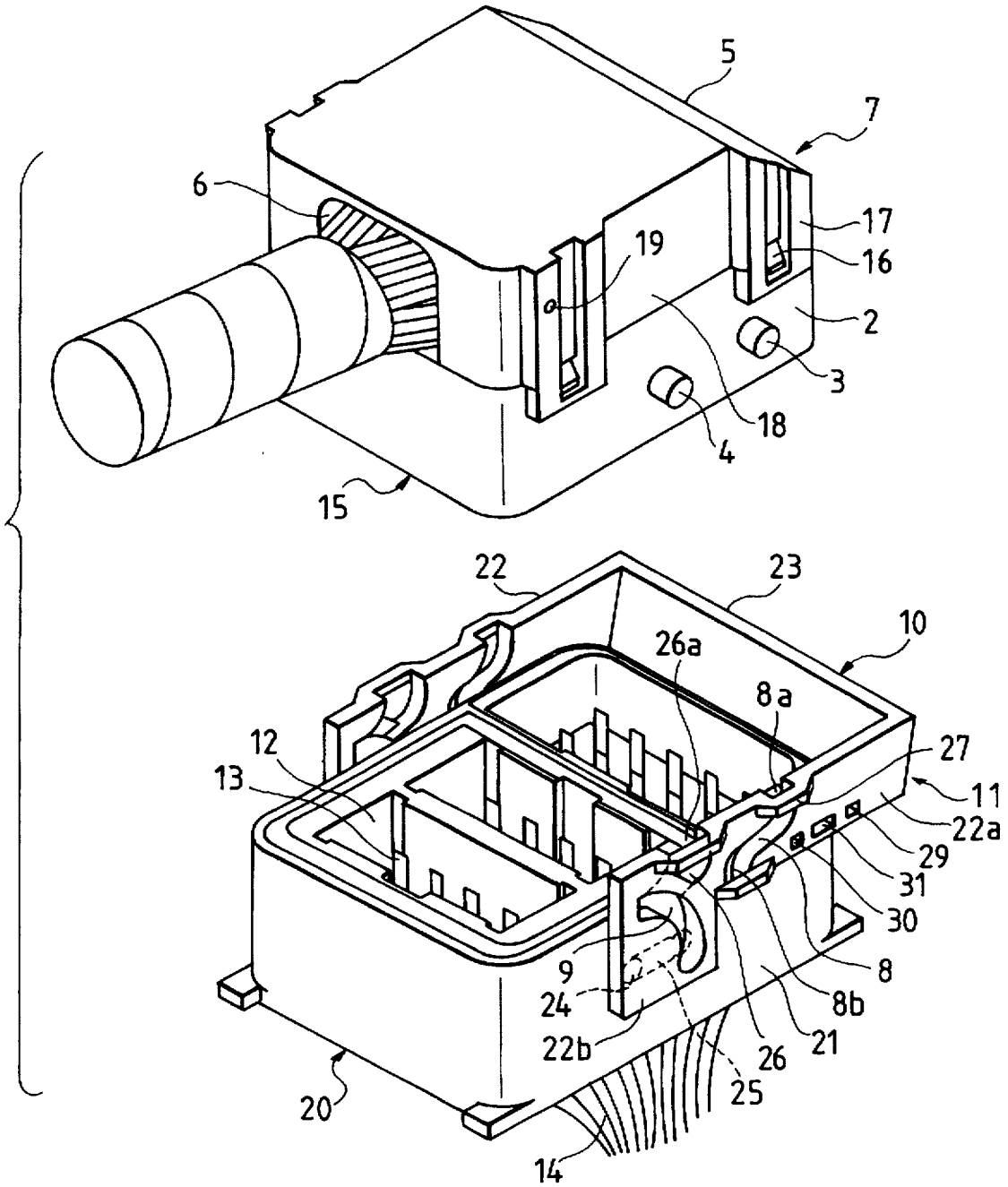
FIG. 1 is an exploded, perspective view of one preferred embodiment of a lever fitting-type connector of the present invention.
Figure 2:
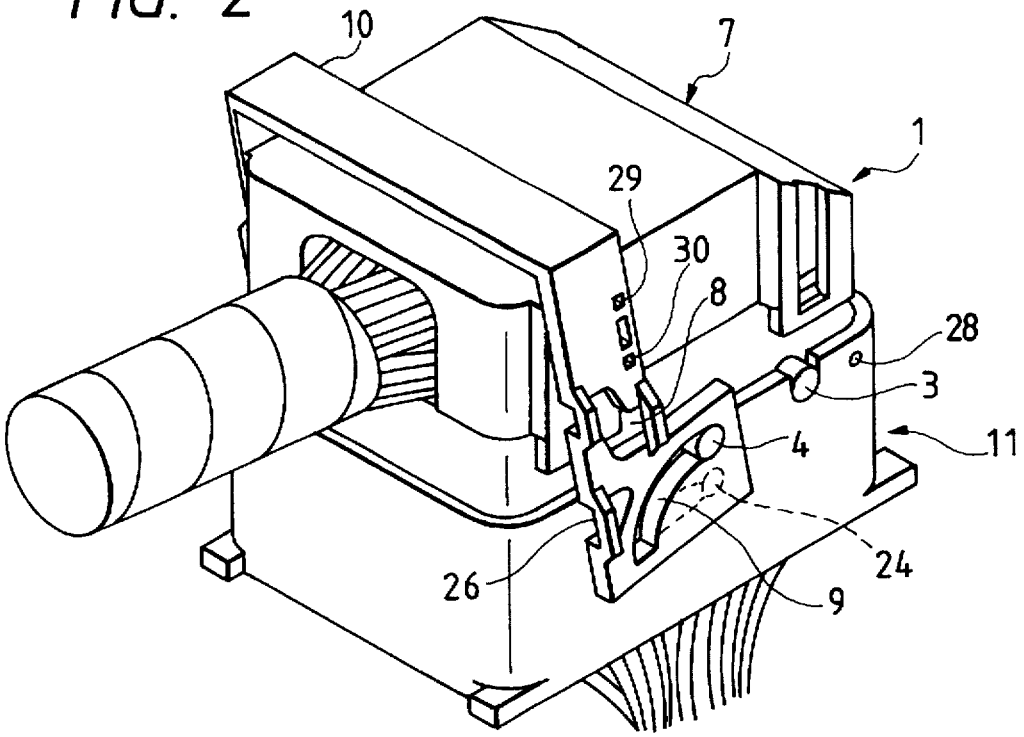
FIG. 2 is a perspective view of the connector in its fitted condition.

FIGS. 1 and 2 shows one preferred embodiment of a lever fitting-type connector of the present invention.

This lever fitting-type connector 1 comprises a male connector 7 having a pair of front and rear engagement pins 3 and 4 (each in the form of a short cylinder) formed on and projecting from each of opposite side walls 2 thereof, and a female connector 11 including an operating lever 10 having, in each of opposite side portions thereof, a generally straight, sliding movement-purpose cam groove 8 for the front auxiliary engagement pin (projection) 3 as well as an arcuate, pivotal movement-purpose cam groove 9 for the rear main engagement pin 4. The male connector 7 includes a cover 5, and wires 6 extend outwardly through a rear wall of the cover 5.

A plurality of fitting portions (not shown) for fitting respectively in connection cavities 12 in the female connector 11 are formed in the male connector 7. Wires 14 are connected respectively to terminals 13 in the cavities 12 and the fitting portions. The cover 5 of the male connector 7 is retained on a male connector housing 15 by respectively engaging retaining projections 16, formed on the connector housing 15, in engagement frame portions 17 formed on the cover 5. The pair of juxtaposed engagement pins 3 and 4 are formed on each of the opposite side walls 2 of the male connector housing 15, and are spaced from each other in a forward-rearward direction (that is, a direction perpendicular to a connector fitting direction. A lock projection 19 for the operating lever 10 is formed on a rear portion of each of opposite side walls 18 of the cover 5.

The operating lever 10 includes a pair of L-shaped side plate portions 22 disposed adjacent respectively to opposite side walls 21 of a female connector housing 20, and an operating plate portion 23 interconnecting the two side plate portions 22. The side plate portion 22 has a narrow portion **22*a* which is equal in width to the operating plate portion 23, and extends from the operating plate portion 23, and a wide portion 22*b* of a rectangular shape which is formed at a distal end of the narrow portion 22*a*, and extends perpendicularly to the narrow portion 22*a*. A pivot pin 24 (see FIG. 3) about which the lever 10 is pivotally movable is formed on an inner surface of the wide portion 22*b* at a distal end portion thereof. Each side wall 21 of the female connector housing 20 has a movement-purpose elongate groove 25 for the pivot pin 24, the groove 25 extending horizontally in the forward-rearward direction. The movement-purpose elongate groove 25 has a narrower portion 25*b* adjacent to its front end portion 25*c*, and the groove 25 can retain or hold the pivot pin 24**.

Figure 3:
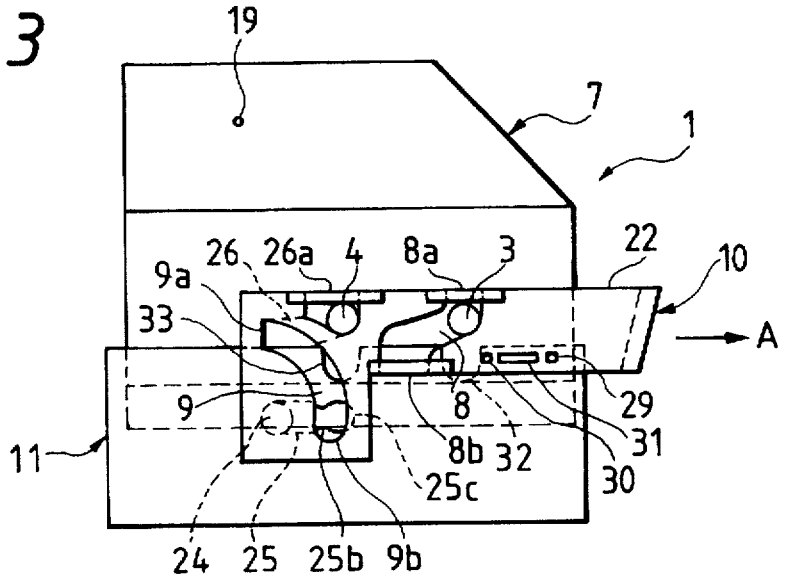
FIG. 3 is a side-elevational view showing male and female connectors in a provisionally-fitted condition.

The pivotal movement-purpose cam groove 9 is formed in the wide portion **22*b* in eccentric relation to the pivot pin 24. When the operating lever 10 is disposed horizontally as shown in FIGS. 1 and 3, the distance between the pivot pin 24 and the pivotal movement-purpose cam groove 9 is the smallest in the horizontal direction, and is the largest in the vertical direction. The pivotal movement-purpose cam groove 9 has a pivotal movement-starting end 9*a* disposed in the vertical direction and a pivotal movement-finishing end 9*b* disposed in the horizontal direction. A communication groove 26 for the rear main engagement pin 4 is formed in each side plate portion 22 of the operating lever 10, and extends from the upper edge (when the lever 10 is disposed horizontally) of the side plate portion 22 to the pivotal movement-starting end 9*a*. The communication groove 26 extends downwardly at its inlet portion 26*a* (which has a length generally equal to the diameter of the engagement pin 4), and further extends from this inlet portion 26*a* to the starting end 9*a* of the pivotal movement-purpose cam groove 9** in a slightly downwardly-slanting manner.

The sliding movement-purpose cam groove 8 for the front auxiliary engagement pin 3 is formed in each side plate portion 22 (that is, in the narrow portion **22*a*) in parallel relation to the communication groove 26. The sliding movement-purpose cam groove 8 has a downwardly-extending inlet portion 8*a* in the upper edge of the side plate portion 22, and further extends from this inlet portion 8*a* to the lower edge of the side plate portion 22 in a slightly downwardly-slanting manner. The cam groove 8 has a downwardly-directed outlet portion 8*b* at its lower end, and has sliding-movement purpose slanting surfaces 8*c* (see FIG. 4) for the auxiliary engagement pin 3 which are formed respectively on opposite side edges of the cam groove 8 between the inlet portion 8*a* and the outlet portion 8*b*. An arch portion 27 is formed astride each of the inlet and outlet portions 8*a* and 8*b* of the sliding movement-purpose cam groove 8 and the inlet portion 26*a* of the communication groove 26 in each side plate portion 22. The operating lever 10 is slidable in the horizontal direction, with each pivot pin 24, each engagement pin 3 and each engagement pin 4 engaged respectively in the associated movement-purpose elongate groove 25, sliding movement-purpose cam groove 8 and communication groove 26**.

A pair of retaining holes 29 and 30 are formed in the narrow portion **22*a* of the side plate portion 22 of the operating lever 10 adjacent to the operating plate portion 23, and cooperate with the lock projection 19 (which is formed on the cover 5 of the male connector 7) and a lock projection 28 (see FIG. 5) which is formed on the side plate portion 21 of the female connector housing 20 adjacent to the front end thereof. A relief slot 31 is formed between the pair of retaining holes 29 and 30. In accordance with the horizontal sliding movement of the lever 10, the pair of retaining holes 29 and 30 are sequentially engageable with the lock projection 28. In accordance with the pivotal movement of the lever 10, the front retaining hole 29 is engageable with the lock projection 19 on the male connector 7. A pair of pin receiving grooves or notches 32 and 33 (see FIG. 3) are formed in the side wall 21 of the female connector housing 20, and can face the lower sides of the pair of engagement pins 3 and 4**, respectively.

FIGS. 3 to 6 show the operation of the lever fitting-type connector 1. For fitting the two connectors 7 and 11 together, each pair of engagement pins 3 and 4 of the male connector housing 7 are first inserted respectively in the inlet portion **8*a* of the associated sliding movement-purpose cam groove 8 and the inlet portion 26*a* of the associated communication groove 26. In this condition, the operating lever 10 is retracted toward the connector 1, and is held in this position, the front retaining hole 29 engaged with the lock projection 28**.

Figure 4:
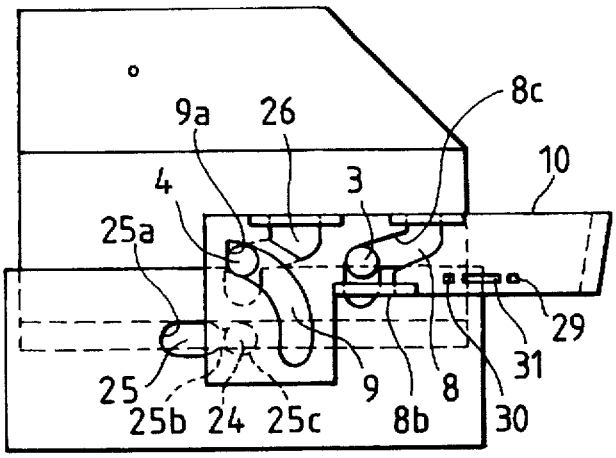
FIG. 4 is a side-elevational view showing a lever in its pulled condition.

Then, the operating lever 10 is pulled forwardly, that is, in a lever-projecting direction as indicated by arrow A. As a result, the front auxiliary engagement pin 3 is moved obliquely downwardly along the sliding movement-purpose cam groove 8, and is disposed in the outlet portion **8*b* whereas the rear main engagement pin 4 passes through the communication groove 26 into the starting end 9*a* of the pivotal movement-purpose cam groove 9, as shown in FIG. 4. At the same time, the pivot pin 24 of the lever 10 slides forwardly along the movement-purpose elongate groove 25 from its rear end 25*a*, and passes past the narrower portion 25*b*, and is retained in its front end 25*c*. The lock projection 28 passes through the slot 31, and is engaged in the retaining hole 31**.

Figure 5:
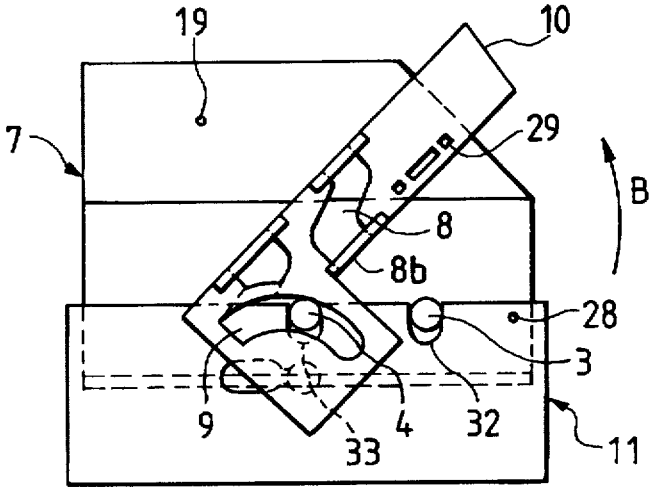
FIG. 5 is a side-elevational view showing the lever as pivotally moved.
Figure 6:
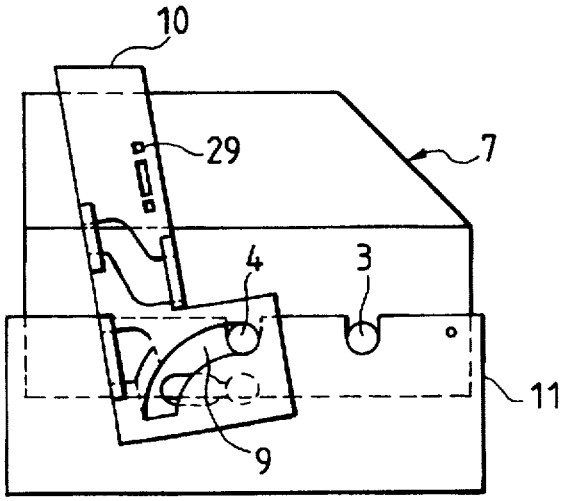
FIG. 6 is a side-elevational view showing the connector in its fitted condition.
Figure 7A:
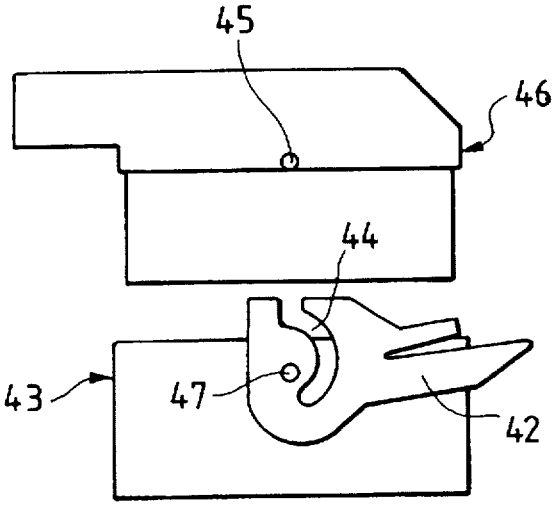
FIG. 7(a) Prior Art
FIG. 7(*a*) is a side-elevational view of a conventional connector before the fitting of the connector.
Figure 7B:
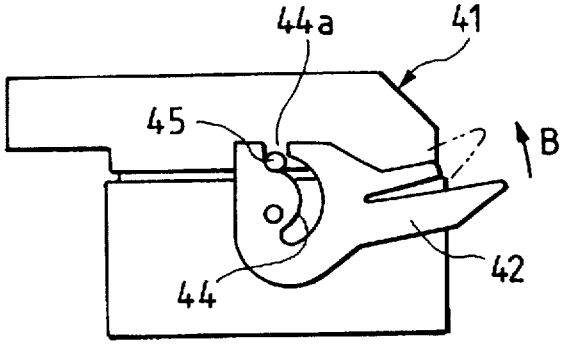
FIG. 7(b) Prior Art
Figure 7C:
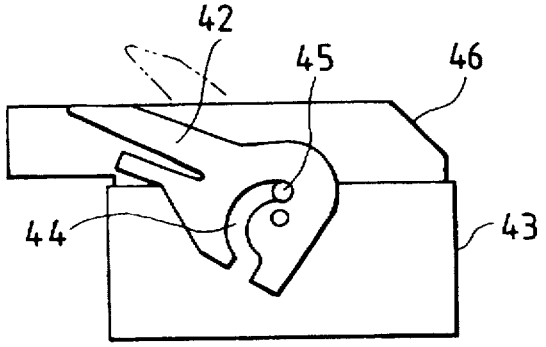
FIG. 7(c) Prior Art

Then, the lever 10 is pivotally moved in a direction of arrow B as shown in Fig. 5. As a result, the front auxiliary engagement pin 3 is disengaged from the outlet portion **8*b* of the sliding movement-purpose cam groove 8, and is brought into opposed relation to the pin receiving groove 32, whereas the rear main engagement pin 4 slidingly moves along the pivotal movement-purpose cam groove 9 to gradually approach the female connector 11. As a result, the male connector 7 is drawn toward the female connector 11, and is fitted therein. Simultaneously with the fitting of the male connector 7 into the female connector 11, the retaining hole 29 in the lever 10 is engaged with the lock projection 19 of the female connector 7, thereby retaining the lever 10**.

The above embodiment can be modified into an arrangement in which the pivotal movement-purpose cam grooves 9 and the sliding movement-purpose cam grooves 8 are formed not in the lever 10 but in the male connector 7, and the main engagement pins 4 and the auxiliary engagement pins 3 are formed on the lever 10, and the pivot pins are formed on the female connector 11, and the movement-purpose elongate grooves 25 are formed in the lever 10. The sliding movement-purpose cam groove 8 may be replaced by any other suitable sliding movement-purpose slanting portion having a slanting surface similar to the slanting surface 8*c*. In such a case, the auxiliary engagement pin 3 is not limited to the pin, but may be a suitable projection.

In the present invention, since the lever can be retracted in the direction opposite to the lever-projecting direction before the connectors are fitted together, the lever will not interfere with an external object during the manufacturing process, the shipping and so on. Therefore, the lever is prevented from damage and disengagement, and besides a large space will not be occupied by the projected lever, and the connector can be easily stored in a pallet or the like in a space-saving manner. For fitting the connectors together, the lever is pulled, thereby providing a sufficient force to effect the fitting of the connectors.

What is claimed is:

1. A lever fitting-type connector comprising:

a first connector on which a lever is pivotally mounted, the lever having a pivotal cam groove and a pivot pin;

a second connector having an engagement pin and an auxiliary engagement projection disposed proximate the engagement pin;

the first connector engaging the second connector in a connecting direction;

the lever having a lever groove including a sliding slanting portion extending generally transversely to the connecting direction for cooperating with the auxiliary engagement projection the lever groove having an inlet portion and an outlet portion wherein the auxiliary engagement projection enters the lever groove at the inlet portion and exits the lever groove at the outlet portion, the pivotal cam groove having a communication groove for receiving said engagement pin; and an elongate groove for receiving the lever pivot pin to allow the lever to move in a direction transverse to the connecting direction, the elongate groove being provided on the first connector.

2. A lever fitting-type connector according to claim 1, wherein a pair of retaining holes for engagement with a lock projection on the first connector are formed in the lever, and are spaced from each other.

3. A connector comprising:

a first member and a second member, the first member engaging the second member in a connecting direction;

the first member including a lever, the lever having a pivot pin and a cam, the lever being rotatable about the pivot pin;

the second member including an engagement pin, wherein the cam and the engagement pin cooperate to join the first member and the second member together; and the pivot pin being mechanically connected to an elongate groove, the pivot pin being movable within the elongate groove;

the lever having a lever groove including a sliding slanting portion extending generally transversely to the connecting direction for cooperating with the auxiliary engagement projection the lever groove having an inlet portion and an outlet portion wherein the auxiliary engagement projection enters the lever groove at the inlet portion and exits the lever groove at the outlet portion.

4. A connector according to claim 3, wherein the lever includes an inlet groove for receiving the engagement pin.

5. A connector according to claim 3, wherein the lever includes a slanted groove, being oriented at an angle different from the connection direction, that cooperates with the engagement pin.

6. A connector according to claim 3, wherein the lever includes first and second retaining holes, the first and second retaining holes being spaced from one another.

7. A connector according to claim 6, wherein the first and second retaining holes engage at least one lock projection.

8. A connector comprising:

a first member and a second member;

the first member including a lever;

the lever having a pivot pin disposed on a first end;

the lever being rotatable about the pivot pin;

the lever having a first position wherein the first end of the lever is a first distance from the first member; and the lever having a second position wherein the first end of the lever is a second distance from the first member, the second distance being different from the first distance, the lever having a third position wherein the lever is circumferentially spaced from the second position, and wherein the first member is joined to the second member when the lever is in the third position.

* * * * *